US012259172B1

(12) United States Patent
Puzzo

(10) Patent No.: US 12,259,172 B1
(45) Date of Patent: Mar. 25, 2025

(54) ICE DISPENSER

(71) Applicant: SERVO LLC, Alton Bay, NH (US)

(72) Inventor: Joseph G Puzzo, Alton Bay, NH (US)

(73) Assignee: SERVO LLC, Alton Bay, NH (US)

( * ) Notice: Subject to any disclaimer, the term of this patent is extended or adjusted under 35 U.S.C. 154(b) by 0 days.

(21) Appl. No.: 18/830,063

(22) Filed: Sep. 10, 2024

(51) Int. Cl.
*F25C 5/00* (2018.01)
*F25C 5/20* (2018.01)

(52) U.S. Cl.
CPC ..... *F25C 5/24* (2018.01)

(58) Field of Classification Search
CPC ..... F25C 5/20; F25C 5/22; F25C 5/24; F25C 5/182; B67D 3/0083; B67D 3/00; B67D 3/0051
USPC ..... 222/146.6, 412, 241, 413, 185.1, 240
See application file for complete search history.

(56) References Cited

U.S. PATENT DOCUMENTS 1,529,379 A * 3/1925 Thompson ..... A47G 19/34 74/528
1,814,342 A * 7/1931 Smith ..... B67D 3/0029 280/30
3,144,965 A * 8/1964 Burton ..... B67D 1/16 222/407
3,610,482 A * 10/1971 Van, Jr. ..... F25C 5/20 222/413
3,715,119 A * 2/1973 Shelley ..... F25C 5/20 222/413
4,136,803 A * 1/1979 Tobias ..... A47F 1/03 222/413
4,470,522 A * 9/1984 Lents ..... B67D 3/00 222/410
4,802,609 A * 2/1989 Morse ..... A47F 1/035 222/424.5
4,942,983 A * 7/1990 Bradbury ..... F25C 5/24 222/413
4,997,109 A * 3/1991 Carper ..... A23G 9/28 222/413
5,219,103 A * 6/1993 Carper ..... G01F 11/10 222/413
6,386,393 B1 * 5/2002 Paulovich ..... B67D 3/0083 211/80

(Continued)

FOREIGN PATENT DOCUMENTS

JP 2006242451 A 9/2006
WO 2010021175 A1 2/2010

*Primary Examiner* — Charles P. Cheyney
(74) *Attorney, Agent, or Firm* — Caldwell Intellectual Property Law

(57) ABSTRACT

An ice dispenser is disclosed. The ice dispenser includes a container configured to store ice, a stand configured to maintain the container at an angle relative to a horizontal surface, an ice chute mechanically attached to the container, wherein the ice chute is configured to direct the ice from the container to a point of delivery, an auger, wherein the auger includes a helical blade that rotates within the container, and wherein the helical blade is configured to capture and propel the ice stored in the container along a shaft to the ice chute and the shaft is parallel to a longitudinal axis of the container, a driver, wherein the driver is operatively connected to a proximal end of the auger such that rotating the driver actuates the auger and a lid configured to enclose the container, wherein the driver is connected to the auger through the lid.

19 Claims, 8 Drawing Sheets

(56) References Cited

U.S. PATENT DOCUMENTS

| | | | | |
|---|---|---|---|---|
| 6,758,047 | B1 * | 7/2004 | Giles | F25C 5/182 62/344 |
| 7,886,936 | B2 * | 2/2011 | Helline | F25D 3/08 221/96 |
| 7,905,200 | B1 * | 3/2011 | Gaston | A01K 5/0291 119/51.11 |
| 9,593,801 | B2 * | 3/2017 | Love | B67D 3/0083 |
| 11,454,438 | B2 | 9/2022 | Njaastad et al. | |
| 11,524,887 | B2 * | 12/2022 | Davis | B67D 3/0051 |
| 2010/0294618 | A1 | 11/2010 | Jennison | |

* cited by examiner

ICE DISPENSER

FIELD OF THE INVENTION

The present invention generally relates to the field of ice dispensing system. In particular, the present invention is directed to an ice dispenser.

BACKGROUND

Ice dispensers are widely used to provide convenient access to ice. Electrical ice dispensers are equipped with complex mechanisms, including motors, sensors, and control circuits, which automate the process of dispensing ice. Although electrical ice dispensers offer the advantage of automation and ease of use, they tend to be inefficient due to their reliance on continuous power supply and energy-intensive components. Electrical ice dispensers require electricity, which is not always ideal. In settings without reliable access to electricity, such as outdoor events, remote locations, or off-grid areas, electrical ice dispensers become impractical or unusable. Furthermore, the complexity of the electrical components makes them prone to frequent malfunctions and breakdowns, necessitating regular maintenance and repairs. There is a growing demand for ice dispensers that provide all the essential functions of ice dispensing without the inefficiencies associated with electrical systems.

SUMMARY OF THE DISCLOSURE

In an aspect, an ice dispenser is disclosed. The ice dispenser includes a container, wherein the container is configured to store ice, a stand, wherein the stand is configured to maintain the container at an angle relative to a horizontal surface, an ice chute mechanically attached to the container, wherein the ice chute is configured to direct the ice from the container to a point of delivery, an auger, wherein the auger includes a helical blade that rotates within the container, and wherein the helical blade is configured to capture and propel the ice stored in the container along a shaft to the ice chute and the shaft is parallel to a longitudinal axis of the container, a driver, wherein the driver is operatively connected to a proximal end of the auger such that rotating the driver actuates the auger and a lid configured to enclose the container, wherein the driver is connected to the auger through the lid.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

At a high level, aspects of the present disclosure are directed to an ice dispenser. The ice dispenser includes a container, wherein the container is configured to store ice, a stand, wherein the stand is configured to maintain the container at an angle relative to a horizontal surface, an ice chute mechanically attached to the container, wherein the ice chute is configured to direct the ice from the container to a point of delivery, an auger, wherein the auger includes a helical blade that rotates within the container, and wherein the helical blade is configured to capture and propel the ice stored in the container along a shaft to the ice chute and the shaft is parallel to a longitudinal axis of the container, a driver, wherein the driver is operatively connected to a proximal end of the auger such that rotating the driver actuates the auger and a lid configured to enclose the container, wherein the driver is connected to the auger through the lid.

Ice dispenser may be more compact and may be easily moved compared to electric ice dispensers. With fewer components than electric dispensers, manual models are generally easier to clean and maintain, and they are typically more cost-effective, making them an affordable choice for those who don't require automated ice production. Since the manual models don't rely on electricity, they are versatile and can be used in any location, which also helps reduce energy costs. Exemplary embodiments illustrating aspects of the present disclosure are described below in the context of several specific examples.

Figure 1:
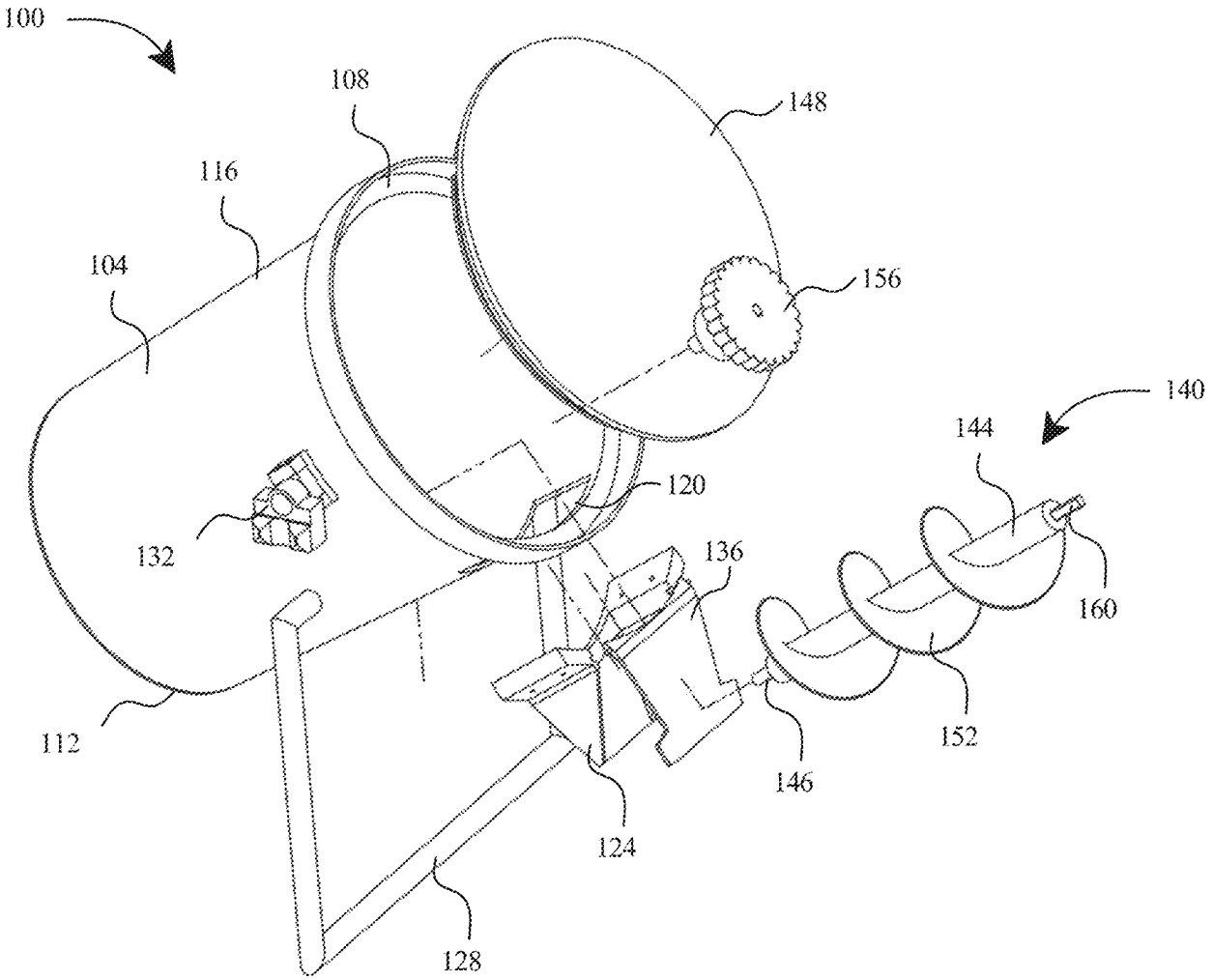
FIG. 1 illustrates an exploded view of an ice dispenser.

Referring now to FIG. 1, an exemplary configuration of an ice dispenser 100 is illustrated. For the purposes of this disclosure, an "ice dispenser" is a device or mechanism designed to store and dispense ice. In a non-limiting example, a user of ice dispenser 100 can obtain ice cubes or crushed ice without having to manually remove them from a tray or container using a scoop. In some embodiments, ice dispenser 100 may be manually operated. For the purposes of this disclosure, a "manual ice dispenser" is an ice dispensing system that does not rely on electricity or automated mechanisms to dispense ice. In some embodiments, ice dispenser 100 may use a manual process to dispense ice cubes or crushed ice. In a non-limiting example, ice dispenser 100 may be used in situations where an electric connection is not available or practical. In some embodiments, ice dispenser 100 may be portable. For the purposes of this disclosure, "portability" refers to the capability for an object to be carried or moved. In some embodiments, ice dispenser 100 may be stationary and designed to remain fixed in one location. For the purposes of this disclosure, "stationary" refers to an object that is fixed in place and not intended to be moved easily. Portable and stationary ice dispenser 100 are further described below. In a non-limiting illustrative example, ice dispenser 100 may be used in outdoor events such as picnics, barbecues, and camping trips where access to electricity is limited. In another non-limiting illustrative example, ice dispenser 100 may be used in indoor events such as parties, gatherings, and the like.

With continued reference to FIG. 1, ice dispenser 100 includes a container 104. As used in this disclosure, a "container" refers to a structure configured to store ice. In a non-limiting example, container 104 may protect ice from external elements, physical damage or contamination, and environmental factors. In some cases, container 104 may include plastic, metal, stainless steel, and/or the like. In some embodiments, container 104 may be a cylinder, where top and bottom surfaces are circles, each having same diameter and area. In some embodiments, container 104 may be a truncated cone. For the purposes of this disclosure, a "truncated cone" is a three-dimensional shape where a first diameter of a top surface of a container is different from a second diameter of a bottom surface of the container. In a non-limiting example, a top surface 108 of container 104 may be larger than a bottom surface 112 of container 104. For example, and without limitation, a diameter of bottom surface 112 of container 104 may be 10.25 inches while a diameter of top surface 108 is 12.75 inches. In a non-limiting example, container 104 may resemble a bucket. In some embodiments, container 104 may include various dimensions. As a non-limiting example, a diameter of bottom surface 112 of container 104 may have a range of 7 inches to 12 inches. As a non-limiting example, a diameter of top surface 108 of container 104 may have a range of 7 inches to 15 inches. As another non-limiting example, a height of container 104 may have a range of 10 inches to 17 inches. For example, and without limitation, a diameter of bottom surface 112 of container 104 may be 10.25 inches, a diameter of top surface 108 is 12.75 inches and a height of container 104 may be 13.894 inches. In some embodiments, side walls 116 may be angled inward as they move from the top to the bottom, forming a tapered profile.

With continued reference to FIG. 1, in some embodiments, container 104 may include double walls with vacuum-sealed space in between. As a non-limiting example, container 104 may include two separate walls, creating a layered structure (double walls); an inner wall and an outer wall with space between them. The space between the inner and outer walls may be vacuum-sealed, meaning that the air has been removed to create a vacuum. As the space between the inner and outer walls of container 104 contains no air or other gases that can conduct heat, heat transfer through conduction and convection can be minimized. This vacuum-sealed space can prevent heat exchange between the interior and exterior environments. In some embodiments, container 104 may include double walls with foam insulation in between them. For the purposes of this disclosure, "foam insulation" is a porous material composed of a network of interconnected cells, which can be filled with gas, liquid, or air. As a non-limiting example, foam may include polyurethane, polystyrene, or the like. The foam layer in between double walls can enhance the thermal insulation by minimizing heat transfer through conduction and convection. The double walls of container 104 disclosed herein are further described in detail with respect to FIG. 2A. In some embodiments, container 104 may include one or more optical markers or alignment indicators that are visible by a user and indicate maximum and/or minimum level of ice that can be stored within container 104. In some embodiments, container 104 may include one or more surface coatings and/or modifications that reduce the likelihood of unwanted adhesion, interference and/or contamination with dust or dirt.

With continued reference to FIG. 1, in some embodiments, container 104 may include a draining hole. For the purposes of this disclosure, a "draining hole" is an opening in a container designed to allow liquids to exit. In a non-limiting example, draining hole may allow melted ice water to be removed from container 104, preventing overflow and maintaining ice quality. In some embodiments, draining hole may be positioned at a lowest point of container 104 or strategically located to facilitate efficient drainage such that the plurality of helical blades 152 is tangential to the side wall 116 of the container 104. In some embodiments, draining hole may include a removable plug or valve to control when draining hole is open or closed or to control the flow rate of removal of liquid from container 104.

With continued reference to FIG. 1, in some embodiments, container 104 may include an aperture 120. For the purposes of this disclosure, an "aperture" is an opening in a physical structure. In a non-limiting example, aperture 120 may be rectangular, circular, and the like. In some embodiments, ice chute 124 may be mechanically attached around aperture 120. In some embodiments, the shape of ice chute 124 may be consistent with the shape of aperture 120. In a non-limiting example, ice stored in container 104 may be dispensed through aperture 120 to ice chute 124.

Figure 7:
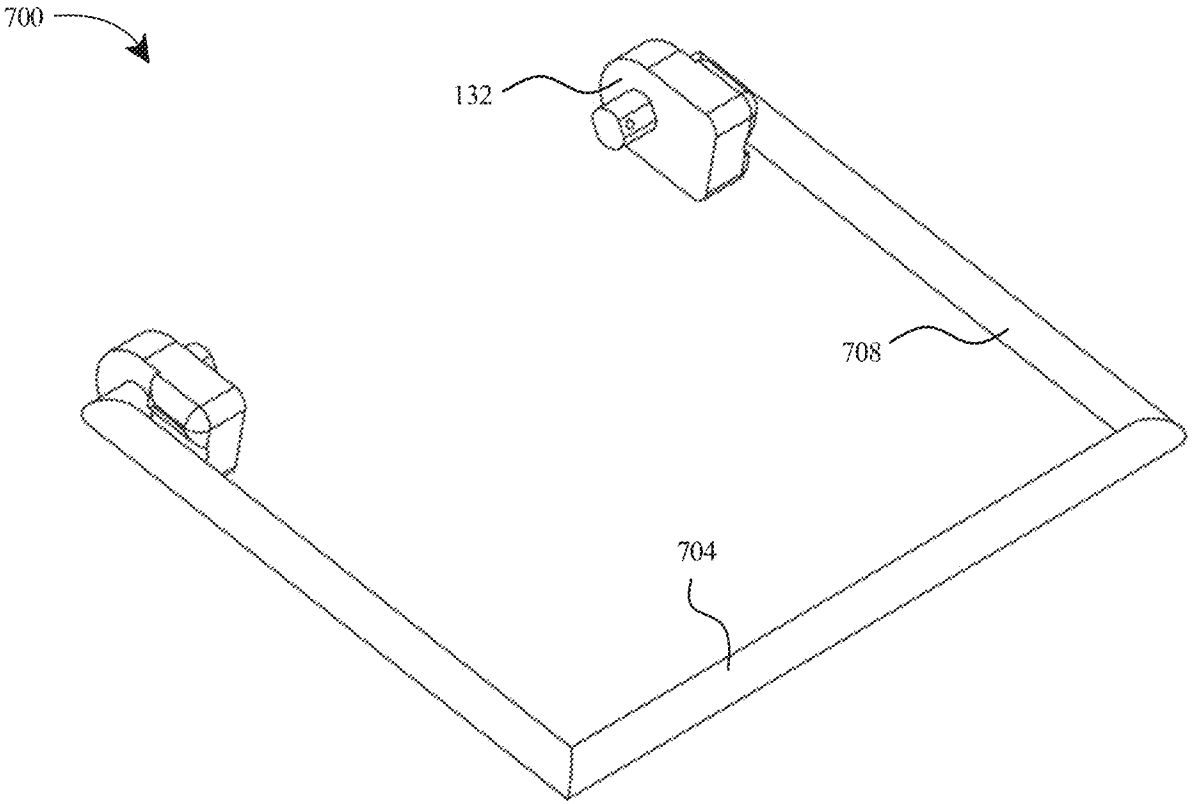
FIG. 7 illustrates an exemplary configuration of a stand.

With continued reference to FIG. 1, ice dispenser 100 includes a stand 128. For the purposes of this disclosure, a "stand" is a component configured to hold a container of an ice dispenser in a fixed position. In some embodiments, stand 128 may include plastic, metal, and the like. In some embodiments, stand 128 may include various shapes. As a non-limiting example, stand 128 may include a horizontal bar and two vertical bars mechanically connected to each other as shown in FIG. 1 and FIG. 7. In some embodiments, stand 128 may be removably attached to container 104. In some embodiments, stand 128 may be used as a handle. In a non-limiting example, a user may move ice dispenser 100 by holding stand 128. In another non-liming example, a user may move ice dispenser 100 by holding container 104. As another non-limiting example, stand 128 may include a rectangular block or cuboid shape. In a non-limiting example, rectangular block or cuboid shape may be used to place ice dispenser 100 securely on a table, ground, and the like. In some embodiments, stand 128 may be permanently attached to container 104. "Permanent attachment" refers to something that is fixed, secured, or affixed in a way that it cannot be detached or removed. As a non-limiting example, permanent attachment may include a variety of techniques, such as but not limited to welding, soldering, brazing, adhesive bonding, or the like.

Figure 2A:
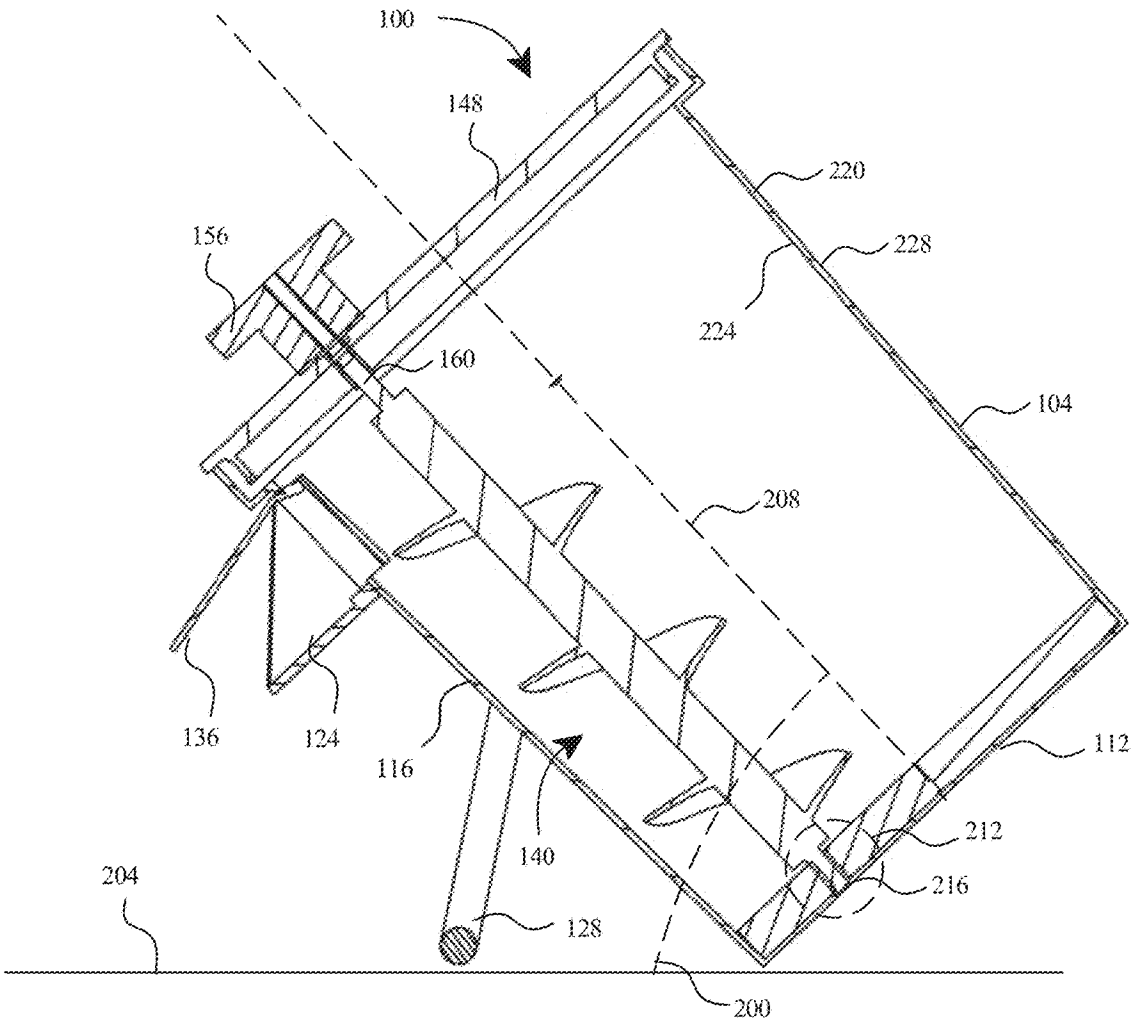
FIG. 2A illustrates a side cross-section view of an ice dispenser.

With continued reference to FIG. 1, stand 128 is configured to maintain container 104 at an angle relative to a horizontal surface. In a non-limiting example, stand 128 may maintain an angle between a longitudinal axis of container 104 and horizontal surface. As a non-limiting example, container 104 may be angled between 30 to 50 degrees relative to horizontal surface. For example, and without limitation, stand 128 may be configured to maintain container 104 at 40 degrees relative to horizontal surface. In some embodiments, stand 128 may be rotatably adjustable via an adjustment mechanism 132. For the purposes of this disclosure, an "adjustment mechanism" is a mechanism that enables the modification of the stand's position or angle. In some embodiments, adjustment mechanism 132 may be configured to adjust an angle of container 104 to multiple angles relative to horizontal surface. In a non-limiting example, stand 128 may be configured to adjust the angle between a longitudinal axis of a container 104 and horizontal surface from 10 degrees to 80 degrees. The longitudinal axis and the horizontal surface disclosed herein are illustrated in FIG. 2A. As a non-limiting example, adjustment mechanism 132 may include hinges or pivot points that provide a rotational axis around which the stand 128 or container 104 can be tilted or adjusted. For example, and without limitation, adjustment mechanism 132 may include a hinge that allows the top part of stand 128 to tilt up or down. In some embodiments, adjustment mechanism 132 may include an locking mechanism. A locking mechanism may be configured to lock the stand 128 at a fixed position. For the purposes of this disclosure, a "locking mechanism" is a mechanism that secures a stand in its adjusted position. As a non-limiting example, locking mechanism may include a screw-tightened clamp, pin locks with a slot, and the like that holds an adjustable stand in place once it has been positioned.

With continued reference to FIG. 1, ice dispenser 100 includes an ice chute 124 mechanically attached to container 104. For the purposes of this disclosure, an "ice chute" is a component that directs ice from a container to a point of delivery. As a non-limiting example, the point of delivery may include a cup, container, and the like. In some embodiments, ice chute 124 may include plastic, metal, stainless steel, and the like. In some embodiments, ice chute 124 may be positioned on a side wall 116 of container 104, closer to top surface 108 of the container 104. In some embodiments, container 104 may include an aperture 120 where ice chute 124 can be positioned. In some embodiments, ice chute 124 may have a tapered shape that narrows from a top portion, where the ice enters the ice chute 124 from container 104, to a bottom portion, where the ice is dispensed from the ice chute 124. The ice chute 124 may be either straight or curved in some embodiments. It may also have various dimensions. As a non-limiting example, ice chute 124 may protrude between 2 inches and 5 inches from side wall 116 of container 104. For example, and without limitation, ice chute 124 may protrude 2.756 inches from side wall 116 of container 104. Additionally, a width of ice chute 124 may range between 2 inches and 5 inches. For example, and without limitation, ice chute 124 may have a tapered shape with a top width of 4 inches and a bottom width of 3.150 inches.

With continued reference to FIG. 1, in some embodiments, ice chute 124 may include gate 136. For the purposes of this disclosure, a "gate" is a component that closes an opening of the ice chute when ice is not getting dispensed. As a non-limiting example, gate 136 may include a gate, flap, and the like. As another non-limiting example, gate 136 may include hinges, and the like. In a non-limiting example, gate 136 may be opened when ice is dispensed, and gate may be closed when ice is not getting dispensed. In some embodiments, gate 136 may be closed due to gravity force. In some embodiments, gate 136 may be further configured to keep an opening of ice chute 124 closed when ice is not getting dispensed, therefore preventing heat transfer through the ice chute 124.

With continued reference to FIG. 1, ice dispenser 100 includes an auger 140. For the purposes of this disclosure, an "auger" is a component that rotates to move ice. In some embodiments, auger 140 may include plastic, stainless steel, metal, and the like. In some embodiments, length of auger 140 or shaft 144 may be consistent with a height of container 104. In some embodiments, length of auger 140 or shaft 144 may be shorter than a height of container 104. Auger 140 (shaft 144) is oriented parallel to a longitudinal axis of container 104. The longitudinal axis of container 104 is illustrated in FIG. 2A. In another embodiment, auger 140 (shaft 144) may be oriented parallel to a side wall 116 of container 104. A parallel orientation of auger 140 and container 104 can facilitate the movement of ice along the length of the auger 140 and the container 104, as the ice can be fed along entire length of auger 140 from the side wall 116 of the container 104.

With continued reference to FIG. 1, in some embodiments, auger 140 may include a tension rod 146. For the purposes of this disclosure, a "tension rod" is a rod that provides adjustable tension along its length. In a non-limiting example, tension rod 146 may create and maintain tension between two points (e.g., bottom surface 112 of container 104 and a lid 148) without the need for additional hardware like screws or bolts. Inside the tension rod 146, a spring mechanism may be positioned to create outward force. The spring may include a coil spring made of metal. The spring may generate tension that pushes the rod's ends outward against the surfaces they are mounted on, holding the rod securely in place without the need for additional hardware.

With continued reference to FIG. 1, auger 140 includes a helical blade 152 that rotates within container 104. For the purposes of this disclosure, a "helical blade" is a component of an auger consists of a spiral-shaped blade wound around a shaft. Helical blade 152 is configured to capture and propel ice stored in container 104 along a shaft to ice chute 124. In some embodiments, helical blade 152 may be configured to break down the ice into smaller pieces. In a non-limiting example, the rotational force applied to helical blade 152 may cause it to turn and interact with the ice; this motion may generate the mechanical force (e.g., shear and compressive forces) needed to break down the ice. In some embodiments, helical blade 152 may include plastic, stainless steel, metal, and the like. In some embodiments, helical blade 152 may include various pitches and diameters. "Pitch" refers to the distance between the edges of one complete turn of the helical blade along the shaft. "Diameter" refers to the overall width of the helical blade, measured from the outer edge of one side to the outer edge of the opposite side. As a non-limiting example, diameter of helical blade 152 may be between 3 inches to 5 inches. For example, and without limitation, the diameter of helical blade 152 may be 4 inches.

With continued reference to FIG. 1, for the purposes of this disclosure, a "shaft" is a component that serves as a longitudinal axis around which a helical blade is wrapped. In some embodiments, shaft 144 may provide structural support and may transmit rotational force necessary for the auger's operation. In some embodiments, shaft 144 may include cylindrical rod or tube. In some embodiments, shaft 144 may include plastic, stainless steel, metal, and the like. In some embodiments, shaft 144 may include various lengths and widths or diameters. "Length" refers to the total axial length of the shaft. As a non-limiting example, length of shaft 144 may be between 10 inches to 17 inches. For example, and without limitation, length of shaft 144 may be 13 inches. As a non-limiting example, width or diameter of shaft 144 may be between ⅛ inches to 2 inches. For example, and without limitation, width or diameter of shaft 144 may be ⅜ inches.

With continued reference to FIG. 1, ice dispenser 100 includes a driver 156. For the purposes of this disclosure, an "driver" is a component that a user physically interacts with to dispense ice. Driver 156 is operatively connected to a proximal end 160 of the auger such that rotating driver 156 actuates auger 140. For the purposes of this disclosure, "operative connection" is a functional linkage between two or more components, allowing them to operate together. In a non-limiting example, a movement of dispense driver 156 turns auger 140, which in turn drives the auger 140 to rotate. In some embodiments, driver 156 may be rotatable clockwise to activate ice dispensing mechanism to actuate auger 140 to dispense ice. In a non-limiting example, driver 156 may provide a point of contact for a user to apply force, moving the dispense driver 156 to initiate an ice dispensing process. Driver 156 may include various materials such as plastic, metal, wood, rubber, and the like. As a non-limiting example, driver 156 may include a handle, bar, cross-shaped bar, and the like. In some embodiments, length of driver 156 may vary. As a non-limiting example, length of driver 156 may be between 6 inches to 10 inches. For example, and without limitation, length of driver 156 may be 8.4 inches.

With continued reference to FIG. 1, in some embodiments, driver 156 may include a knob. For the purposes of this disclosure, a "knob" is a round or rounded handle or projection used to control an ice dispensing mechanism. In a non-limiting example, a knob may be a manually operated component that allows users to grip and turn it to actuate auger 140 to get the ice dispensed. Knobs may be mounted on a shaft or axle (e.g., a proximal end 160 of shaft 144 of auger 140) that connects to auger 140. Knobs may be secured using press-fit designs. Knobs may be designed to rotate, either freely or within a specific range, allowing users to control the amount of ice getting dispensed from ice dispenser 100. In some embodiments, driver 156 may include a rachet. For the purposes of this disclosure, a "rachet" is a component that allows for incremental movement in one direction while preventing movement in the opposite direction.

With continued reference to FIG. 1, in some embodiments, driver 156 may include a grip enhancing feature. For the purposes of this disclosure, a "grip enhancing feature" is an element incorporated into a component that improves the user's ability to hold, manipulate, or control it. As a non-limiting example, grip enhancing features may include textured surface, such as ridges, knurls, grooves, raised patterns, and the like. As another non-limiting example, grip enhancing feature may include flared edges, rubber or silicone grips, finger indents, and the like.

With continued reference to FIG. 1, ice dispenser 100 includes a lid 148. For the purpose of this disclosure, a "lid" is a cover that encloses a container. Driver 156 is connected to auger 140 through lid 148. In a non-limiting example, lid 148 may include a hole where driver 156 can be mounted on and auger 140 can be connected to the driver 156 through the hole. As a non-limiting example, lid 148 may include plastic, metal, glass, and the like. In some embodiments, lid 148 may be detachable from container 104. Detachable described herein may be consistent with removable insertion described below. In some embodiments, lid 148 may be attached to container 104. As a non-limiting example, lid 148 may include a hinge and be attached to container 104 via the hinge. For the purposes of this disclosure, a "hinge" is a component that allows two components to rotate relative to each other along a fixed axis. In some embodiments, hinge may be configured to pivot a lid 148, providing access for adding ice to container 104. In an embodiment, lid 148 may be hinged on any part of container 104 and pivot relative to container 104. In some embodiments, hinge may be configured to pivot a portion of lid 148. In a non-limiting example, hinge may allow one half of lid 148 to pivot relative to another half of lid 148, providing controlled opening and closing. The hinge is strategically placed along the edge of the portion of the lid that is intended to open. For instance, if the lid is divided into two halves, the hinge would be located where one half of the lid meets the stationary part or the container. In a non-limiting example, a lid 148 may be designed to open partially, such as when only half of the lid 148 needs to be opened, while the other half remains closed and stationary.

In some embodiments, lid 148 may be transparent; a user may be able to see the level of ice stored in container 104. In other embodiments, lid 148 may be opaque. In some embodiments, lid 148 may include double walls.

Referring now to FIG. 2A, a side cross-section view of an ice dispenser 100 is illustrated. Stand 128 is configured to maintain container 104 at angle 200 relative to a horizontal surface 204. In a non-limiting example, stand 128 may maintain angle 200 between a longitudinal axis 208 of container 104 and horizontal surface 204 from 10 degrees to 80 degrees. For the purposes of this disclosure, a "longitudinal axis" of a container is an imaginary line that is perpendicular to the bottom surface of the container, around which the container is symmetrically arranged. As a non-limiting example, container 104 may be angled between 30 to 50 degrees relative to horizontal surface 204. For example, and without limitation, stand 128 may be configured to maintain longitudinal axis 208 of container 104 at 40 degrees relative to horizontal surface 204. Auger 140 (shaft 144) is oriented parallel to longitudinal axis 208 of container 104. In a non-limiting example, auger 140 may be positioned such that its shaft 144 is aligned parallel to longitudinal axis of the container 104 so that the length of auger 140 runs in the same direction as longitudinal axis, maintaining a consistent distance from it along its entire length. In another non-limiting example, auger 140 may be positioned such that its shaft 144 is aligned parallel to side wall 116 of the container 104 so that the length of auger 140 runs in the same direction as the side wall 116, maintaining a consistent distance from it along its entire length. A parallel orientation of auger 140 and container 104 can facilitate the movement of ice along the length of the auger 140 and the container 104, as the ice can be fed along entire length of auger 140 from the side wall 116 of the container 104.

With continued reference to FIG. 2A, driver 156 is operatively connected to a proximal end 160 of auger 140 such that rotating driver 156 actuates auger 140. In a non-limiting example, driver 156 may be mounted on a lid 148 and auger 140 can be connected to the driver 156 through the lid 148. In some embodiments, auger 140 may be positioned adjacent to ice chute 124 within container 104, such that the ice carried by the auger 140 is directed towards the ice chute 124 for dispensing. In some embodiments, container 104 may include an auger anchoring point 212 at a bottom surface 112 of container 104. For the purposes of this disclosure, an "auger anchoring point" is a specific location or component that receives an auger and allows the auger to rotate freely on the auger anchoring point. In some embodiments, auger anchoring point 212 may receive a distal end 216 of auger 140. In some embodiments, auger anchoring point 212 may be located as low as structurally feasible on bottom surface 112 of the container 104, considering a size of helical blade 152. In a non-limiting example, auger anchoring point 212 may be located as low as structurally feasible on bottom surface 112 of the container 104 to allow auger 140 to push ice upwards and against side walls 116 of container 104. In another non-limiting example, placing auger anchoring point 212 at the lowest anchoring point may allow auger 140 to interact with ice stored within container 104 from the very stand of the container 104 so that the auger 140 can effectively move, process, or dispense the ice with minimal residual ice left in the container 104. This way, the auger is tangential to side wall 116 such that the helical blades of the auger is not impeded by side wall 116 while maximizing the amount of ice that can be dispensed through ice chute 124. In some embodiments, auger anchoring point 212 may be permanently attached or removably inserted to the bottom surface 112 of container 104. For the purposes of this disclosure, "removably inserted" refers to an object that has been inserted or placed into another object such that the object can be removed from the other object without causing damage or leaving any residue behind. In some embodiments, auger 140 may be attached or inserted to auger anchoring point 212 through a shaft that fits into cylindrical opening of auger anchoring point 212. In some embodiments, auger anchoring point 212 may provide stable support for a shaft of auger 140 to ensure that the auger 140 remains in place while allowing free rotation. In some embodiments, auger anchoring point 212 may support auger 140 axially, allowing it to spin along its longitudinal axis. In some embodiments, auger anchoring point 212 may include metal, plastic, and the like. In some embodiments, auger anchoring point 212 may include various shape. As a non-limiting example, auger anchoring point 212 may include a cylindrical shape with flanged or protruded ends.

With continued reference to FIG. 2A, in some embodiments, container 104 may include double walls with foam insulation 220 in between them. As a non-limiting example, foam insulation 220 may include polyurethane, polystyrene, or the like. The foam insulation 220 in between double walls can enhance the thermal insulation by minimizing heat transfer through conduction and convection. can prevent heat exchange between the interior and exterior environments. Double walls may comprise two layers-inner wall 224 and outer wall 228. As a non-limiting example, container 104 may include two separate walls, creating a layered structure (double walls); an inner wall 224 and an outer wall 228 with vacuum-sealed space or foam insulation 220 between them. For the purposes of this disclosure, an "inner wall" is a wall of a container that faces the contents or the inside of the container. For the purposes of this disclosure, an "outer wall" is a wall of a container that faces the external environment. These walls may be made of durable materials like stainless steel, glass, or plastic, or the like. In some embodiments, container 104 may include double walls with vacuum-sealed space in between. For the purposes of this disclosure, "vacuum" is a region devoid of air or other gases. The space between the inner wall 224 and outer wall 228 may be vacuum-sealed, meaning that the air has been removed to create a vacuum. As the space between the inner wall 224 and outer wall 228 of container 104 contains no air or other gases that can conduct heat, heat transfer through conduction and convection can be minimized. This vacuum-sealed space can prevent heat exchange between the interior and exterior environments.

Figure 2B:
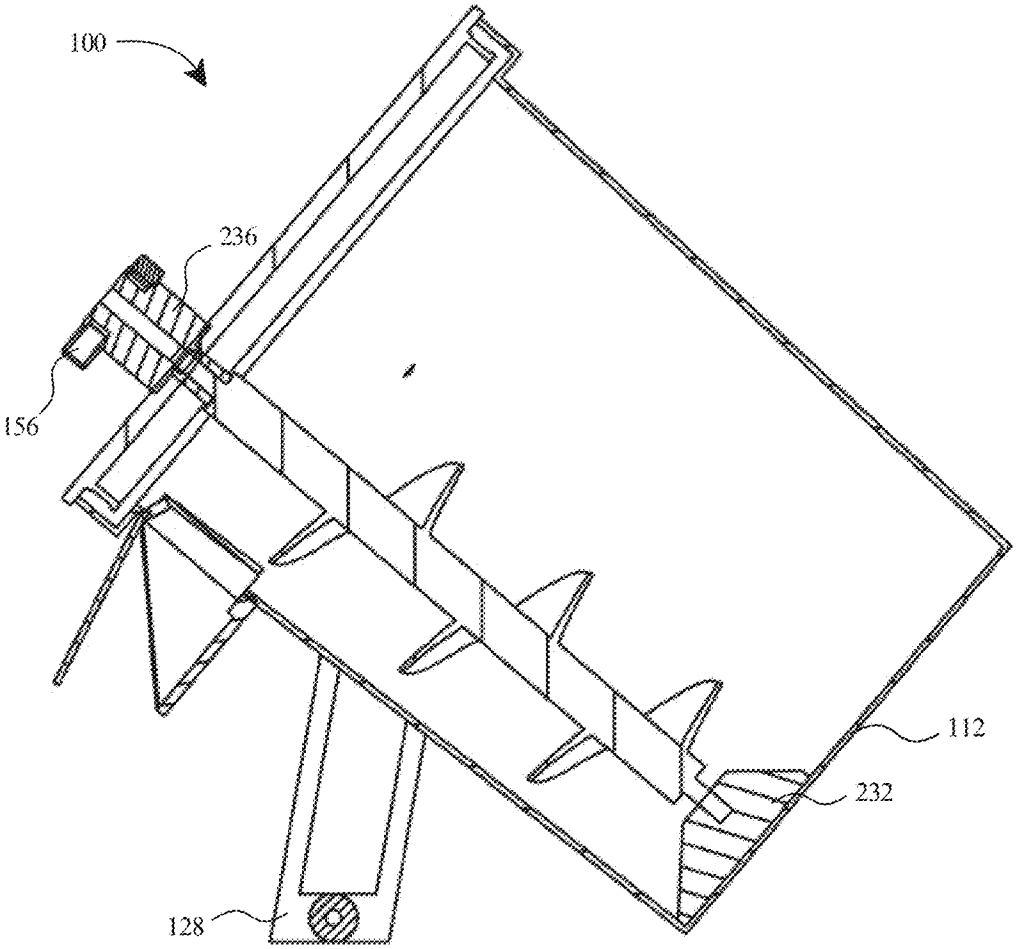
FIG. 2B illustrates a side cross-section view of another ice dispenser with a protruded auger anchoring point.

Referring now to FIG. 2B, a side cross-section view of an ice dispenser 100 with a protruded auger anchoring point 232 is illustrated. For the purposes of this disclosure, a "protruded auger anchoring point" is a specific anchoring location or component where an auger is mounted or secured, and which extends or projects outward from a surface or structure. Auger anchoring point 212 may be extended outward from bottom surface 112 of container 104. Protruded auger anchoring point can take various forms, such as a raised platform, raised boss, post, cylindrical extension, or the like. Additionally, an exemplary configuration of a stand 128 is illustrated in FIG. 2B.

With continued reference to FIG. 2B, additionally, ice dispenser 100 may include a driver 156 that has a toothed wheel 236. In a non-limiting example, rachet (driver 156) may include a toothed wheel 236 and a pawl that engages the teeth, permitting motion in only one direction. The toothed wheel 236 may include a series of teeth around its perimeter that are designed to engage with the pawl. The teeth may be angled or asymmetrical to facilitate movement in one direction while blocking it in the opposite direction. In a non-limiting example, when the ratchet is moved in one direction, the pawl may click over the teeth, but when movement is attempted in the opposite direction, the pawl may lock into place, preventing reversal. Rachet and toothed wheel 236 disclosed herein are further described in detail with respect to FIG. 6.

Figure 3:
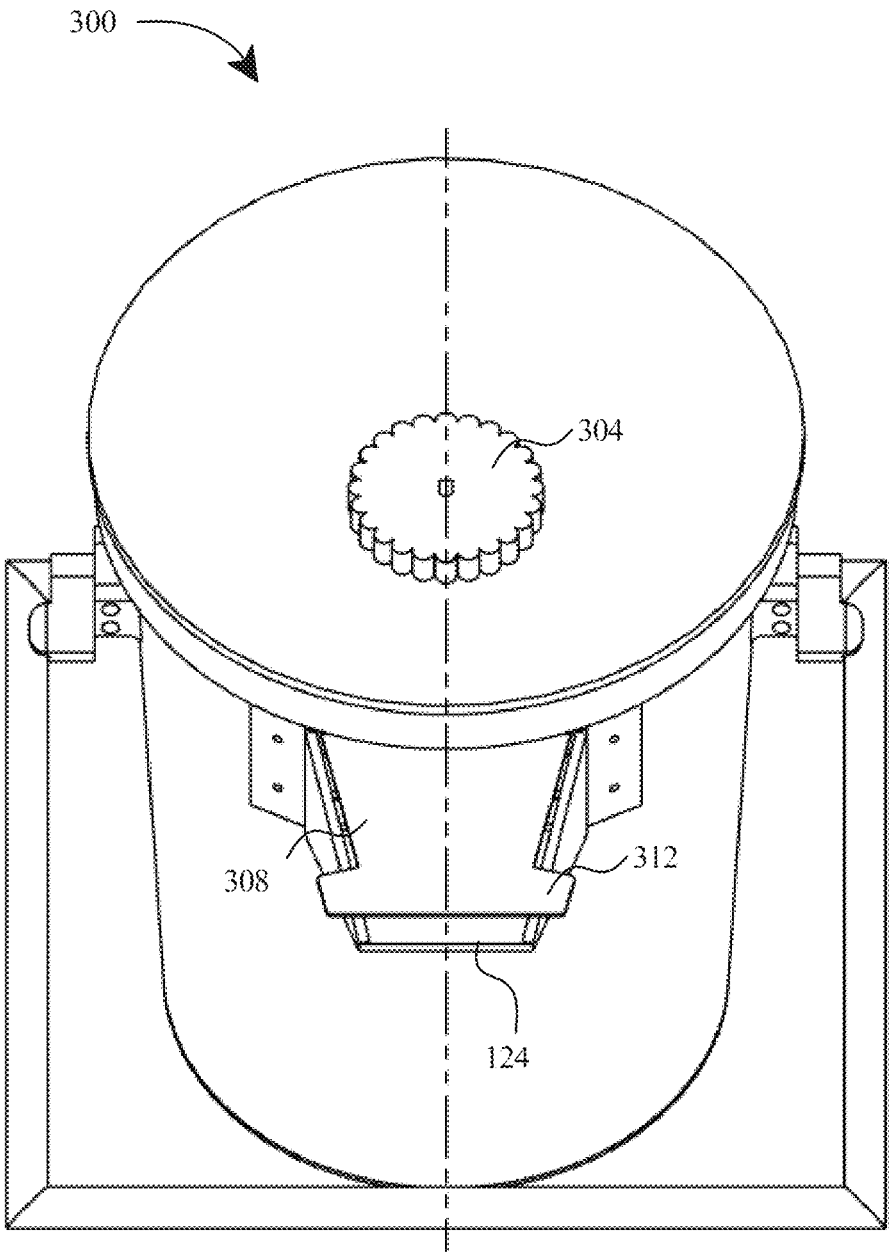
FIG. 3 illustrates a front view of an ice dispenser.

Referring now to FIG. 3, a front view of an ice dispenser 300 is illustrated. Ice dispenser 300 may be consistent with ice dispenser 100. In some embodiments, driver 156 may include a knob 304. In a non-limiting example, a knob 304 may be a manually operated component that allows users to grip and turn it to actuate auger 140 to get the ice dispensed. Knob 304 may be mounted on a shaft or axle (e.g., a proximal end 160 of shaft 144 of auger 140) that connects to auger 140. Knob 304 may be secured using press-fit designs. Knob 304 may be designed to rotate, either freely or within a specific range, allowing users to control the amount of ice getting dispensed from ice dispenser 300. In some embodiments, ice chute 124 may have a tapered shape that narrows from top to bottom. In a non-limiting example, ice chute 124 may feature a wider opening at the top, where ice enters from container 104, and a narrower exit at the bottom. In some embodiments, flap 308 may include a flared edge 312. For the purposes of this disclosure, a "flared edge" is an edge or rim of a component that widens or expands outward. The flared edge 312 can increase the surface area such that a user can easily grasp. In a non-limiting example, when ice becomes stuck in ice chute 124, a user can open flap 308 by gripping its flared edge 312, allowing the user to clear the blockage without directly touching the ice. As a non-limiting example, ice dispenser 300 may include a flap 308 (gate 136). In a non-limiting example, flap 308 may be opened when ice is getting dispensed and flap 308 may be closed when ice is not getting dispensed. In some embodiments, flap 308 may be closed due to gravity force. In some embodiments, flap 308 may be configured to keep an opening of ice chute 124 closed when ice is not getting dispensed, therefore preventing heat transfer through the ice chute 124.

Figure 4:
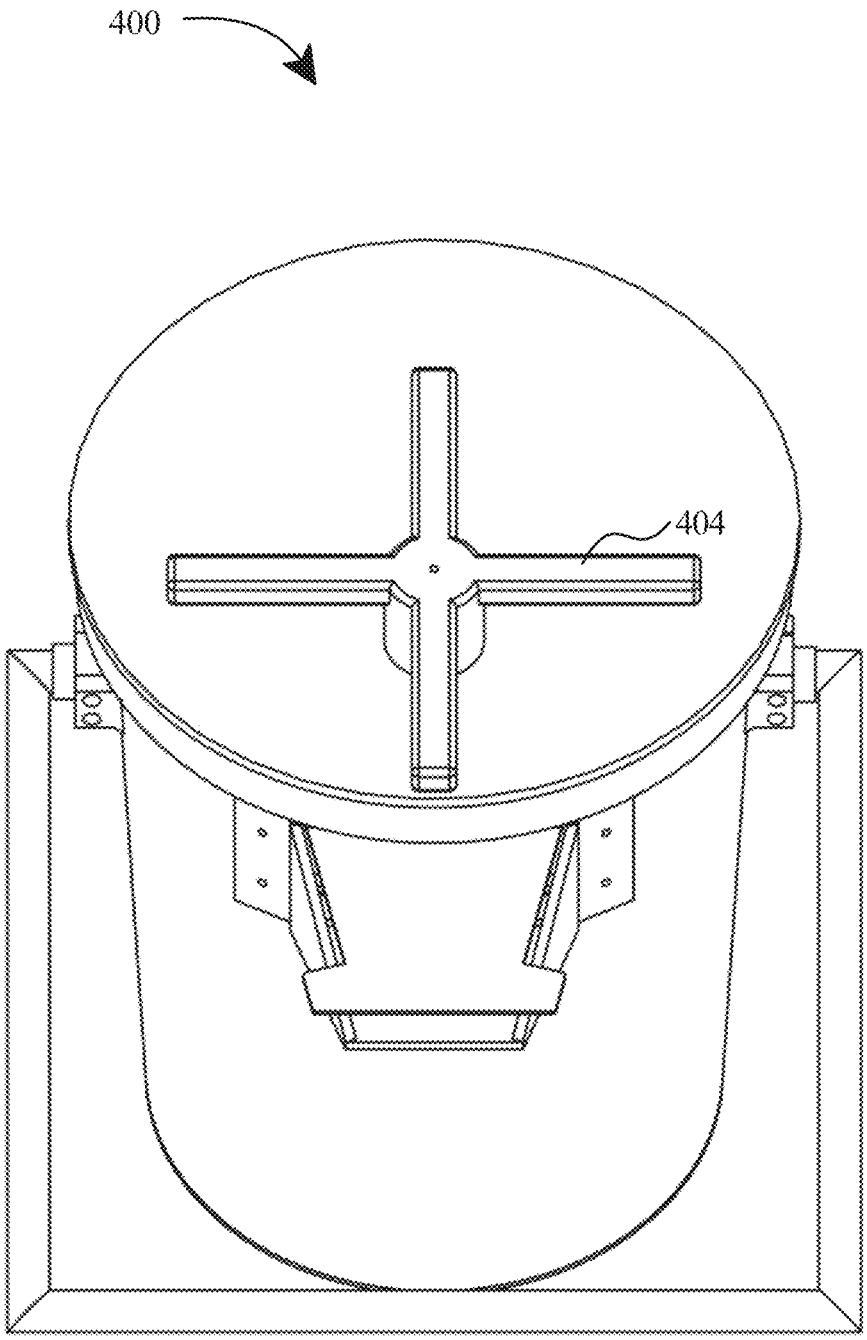
FIG. 4 illustrates an exemplary configuration of a driver on an ice dispenser.

Referring now to FIG. 4, an exemplary configuration of a driver 156 on an ice dispenser 400 is illustrated. Ice dispenser 400 may be consistent with ice dispenser 100. In some embodiments, driver 156 may include a cross handle 404. For the purposes of this disclosure, a "cross handle" is a type of handle with cross-shaped design. Cross handle 404 may include two perpendicular arms extending from a central hub, creating a shape similar to a "plus" sign (+). The hub can serve as the pivot point for the handle's rotation.

Figure 5:
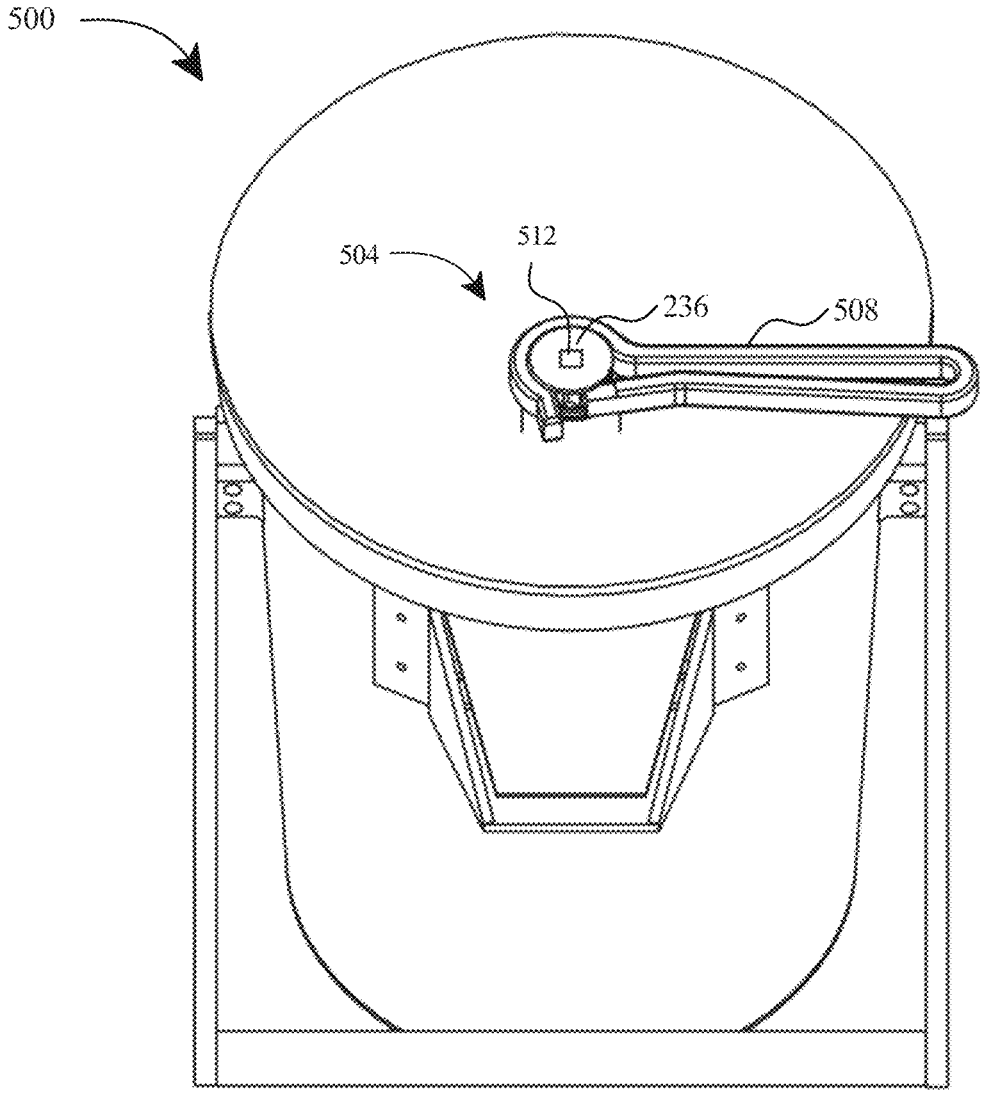
FIG. 5 illustrates another exemplary configuration of a driver on an ice dispenser.

Referring now to FIG. 5, another exemplary configuration of a driver 156 on an ice dispenser 500 is illustrated. Ice dispenser 500 may be consistent with ice dispenser 100. In some embodiments, driver 156 may include a rachet 504. Rachet 504 may include a toothed wheel 236 and a lever arm 508 having a pawl that engages teeth of the toothed wheel 236, permitting motion in only one direction. For the purposes of this disclosure, a "lever arm" is a mechanical component or feature that consists of a rigid bar or rod pivoted at a fixed point. The fixed point may be center point 512 of a toothed wheel 236. For the purposes of this disclosure, a "center point" is a middle point of a toothed wheel around which the wheel rotates. The lever arm 508 and toothed wheel 236 disclosed herein is further described with respect to FIG. 6.

Figure 6:
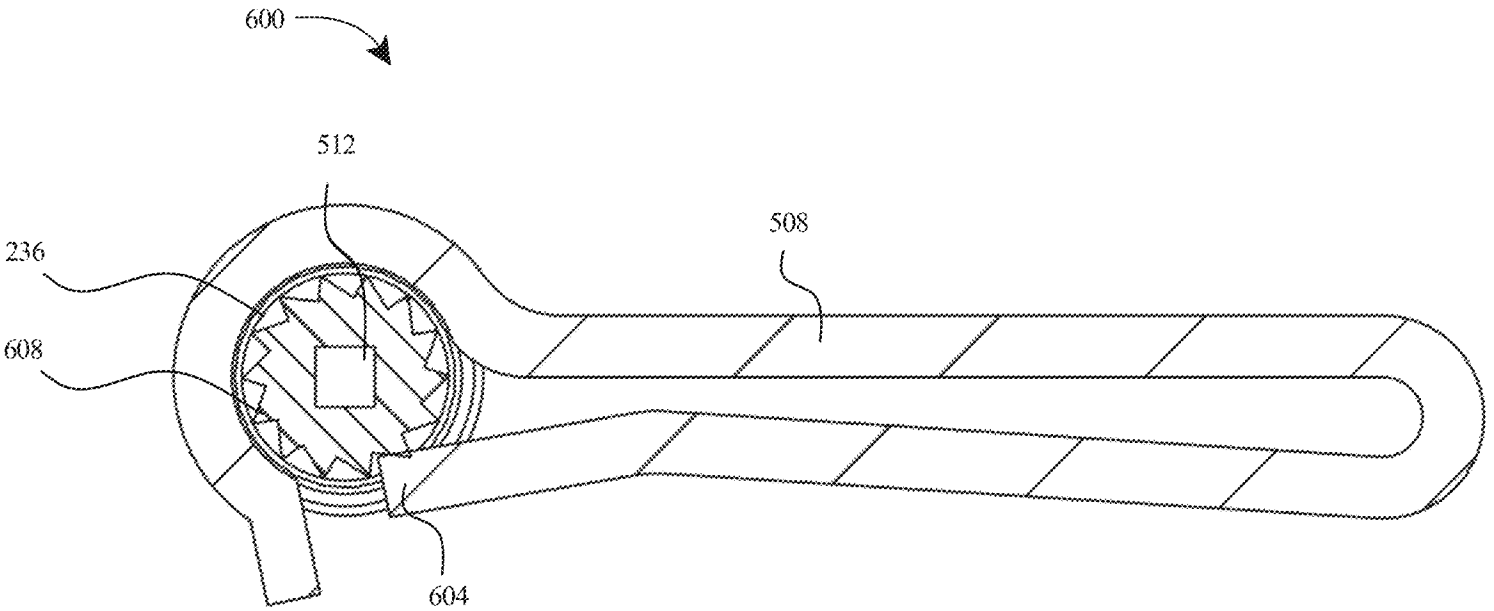
FIG. 6 illustrates an exemplary configuration of a rachet for an ice dispenser.

Referring now to FIG. 6, an exemplary configuration of a rachet 600 is illustrated. Rachet 600 may be consistent with a driver 156 and/or rachet 504. Rachet 600 may include a toothed wheel 236 and lever arm 508 having a pawl 604 that engages teeth 608 of toothed wheel 236, permitting motion in only one direction. For the purposes of this disclosure, a "pawl" is a mechanical component or feature that engages with the teeth of a toothed wheel. Pawl 604 may pivot on a fixed point when a user engages with lever arm 508 and may be designed to lock into the spaces between teeth 608 of toothed wheel 236. The toothed wheel 236 may include a series of teeth 608 around its perimeter that are designed to engage with the pawl 604 of lever arm 508. For the purposes of this disclosure, "teeth" are projections or notches around the circumference of a toothed wheel. Teeth 608 may be evenly spaced around the circumference of a toothed wheel 236. Teeth 608 may be angled or asymmetrical to facilitate movement in one direction while blocking it in the opposite direction. Teeth 608 may be triangular or sawtooth-shaped, with an angled or sloped leading edge and a steeper trailing edge. The leading edge may be designed to allow the pawl 604 to slide over it as lever arm 508 rotates in the allowed direction (e.g., clockwise). In a non-limiting example, when the lever arm 508 is moved in one direction, the pawl 604 may click over the teeth 608, but when movement is attempted in the opposite direction, the pawl 604 may lock into place, preventing reversal.

Referring now to FIG. 7, an exemplary configuration of a stand 700. Stand 700 may be consistent with a stand 128. Stand 700 may include a horizontal bar 704 and two vertical bars 708 mechanically connected to each other. For the purposes of this disclosure, a "horizontal bar" is a structural component that is oriented parallel to a horizontal surface. Horizontal bar 704 may serve as the main crossbar or connecting element of the stand (e.g., connecting vertical bars 708), providing lateral support and stability. Horizontal bar 704 can form as the base or a support level for the stand 700, ensuring that the attached container 104 maintain its intended positions or angles. For the purposes of this disclosure, a "vertical bar" is a structural component that is oriented perpendicular to the horizontal bar. Vertical bars 708 may extend upward from the horizontal bar 704, providing vertical support and maintaining the height and structure of the stand 700. Vertical bars 708 may ensure the overall stability of the stand 700 and for supporting any weight or components attached to them. In some embodiments, stand 700 may be used as a handle. In a non-limiting example, a user may hold and move ice dispenser 100 by holding horizontal bar 704 of stand 700.

With continued reference to FIG. 7, in some embodiments, stand 700 may include an adjustment mechanism 132. In some embodiments, adjustment mechanism 132 may be configured to adjust an angle of container 104 to multiple angles relative to horizontal surface. As a non-limiting example, adjustment mechanism 132 may include hinges or pivot points that provide a rotational axis around which the stand 700 or container 104 can be tilted or adjusted. For example, and without limitation, adjustment mechanism 132 may include a hinge that allows the top part of stand 700 to tilt up or down.

What is claimed is:

1. An ice dispenser, the ice dispenser comprising:

a container, wherein the container is configured to store ice, wherein a first diameter of a top surface of the container is different from a second diameter of a bottom surface of the container;

a stand, wherein the stand is configured to maintain the container at an angle relative to a horizontal surface;

an ice chute located on an upper portion of a side wall of the container adjacent to a lid and the top surface of the container, wherein the ice chute is configured to direct the ice from the container to a point of delivery;

an auger, wherein an entirety of the auger is positioned in a half of the container that is closer to the ice chute, wherein the auger comprises a plurality of helical blades that rotates within the container, and wherein the plurality of helical blades is configured to capture and propel the ice stored in the container along the side wall of the container to move the ice from a bottom of the container to the ice chute;

a driver, wherein the driver is operatively connected to a proximal end of the auger such that rotating the driver actuates the auger; and the lid configured to enclose the top surface of the container, wherein the driver is connected to the auger through the lid.

2. The dispenser of claim 1, wherein the container comprises double walls, wherein the double walls comprise an inner wall and an outer wall with foam in between to prevent heat transfer.

3. The dispenser of claim 1, wherein the container comprises a draining hole, wherein the draining hole is configured for draining liquid out of the container.

4. The dispenser of claim 1, wherein the container is cylindrical.

5. The dispenser of claim 1, wherein the stand is configured to maintain the container at 40 degrees relative to the horizontal surface.

6. The dispenser of claim 1, wherein the stand is rotatably adjustable via an adjustment mechanism, wherein the stand is configured to adjust the angle between a longitudinal axis of the container and the horizontal surface from 10 degrees to 80 degrees.

7. The dispenser of claim 6, wherein the adjustment mechanism comprises a locking mechanism, wherein the locking mechanism is configured to lock the stand at a fixed position.

8. The dispenser of claim 1, wherein the ice chute comprises a gate, wherein the gate is configured to close an opening of the ice chute when the ice is not dispensed.

9. The dispenser of claim 1, wherein the ice chute comprises a tapered shape that narrows from a top portion to a bottom portion.

10. The dispenser of claim 1, wherein the container comprises an auger anchoring point at a bottom surface of the container, wherein the auger anchoring point receives a distal end of the auger and allows the auger to rotate freely on the auger anchoring point.

11. The dispenser of claim 10, wherein the auger anchoring point is located on the bottom surface of the container such that the plurality of helical blades is tangential to the side wall of the container, wherein the ice is carried by the auger towards the ice chute.

12. The dispenser of claim 1, wherein the auger comprises a tension rod.

13. The dispenser of claim 1, wherein the helical blade is 4 inches in diameter.

14. The dispenser of claim 1, wherein the driver is rotatable clockwise to actuate the auger.

15. The dispenser of claim 1, wherein the driver comprises a knob.

16. The dispenser of claim 1, wherein the driver comprises a rachet.

17. The dispenser of claim 1, wherein the lid comprises a hinge, wherein the hinge is configured to pivot the lid relative to the container, providing access for adding the ice to the container.

18. The dispenser of claim 1, wherein the lid is detachable from the container.

19. An ice dispenser, the ice dispenser comprising:

a container, wherein the container is configured to store ice, wherein a first diameter of a top surface of the container is different from a second diameter of a bottom surface of the container;

a stand, wherein the stand is configured to maintain the container at an angle relative to a horizontal surface;

an ice chute located on an upper portion of a side wall of the container adjacent to a lid and the top surface of the container, wherein the ice chute is configured to direct the ice from the container to a point of delivery;

an auger, wherein an entirety of the auger is positioned in a half of the container that is closer to the ice chute, wherein the auger comprises a helical blade that rotates within the container, and wherein:

the helical blade is configured to capture and propel the ice stored in the container along a shaft to the ice chute; and the shaft is parallel to the side wall of the container;

a driver, wherein the driver is operatively connected to a proximal end of the auger such that rotating the driver actuates the auger; and the lid configured to enclose the top surface of the container, wherein the driver is connected to the auger through the lid.

* * * * *